United States Patent [19]

Negishi et al.

[11] Patent Number: 4,656,825

[45] **Date of Patent: * Apr. 14, 1987**

[54] SEWING THREAD AND METHOD FOR MANUFACTURING THE SAME

[75] Inventors: Takao Negishi; Teiryo Kojima, both of Otsu, Japan

[73] Assignee: Toray Industries, Inc., Tokyo, Japan

[ * ] Notice: The portion of the term of this patent subsequent to Apr. 1, 2003 has been disclaimed.

[21] Appl. No.: 664,506

[22] Filed: Oct. 25, 1984

Related U.S. Application Data

[62] Division of Ser. No. 463,030, Feb. 1, 1984, Pat. No. 4,513,565.

[51] Int. Cl.[4] ..... D02G 1/02; D02G 1/20; D02G 3/46

[52] U.S. Cl. ..... 57/289; 57/208; 57/236; 57/239; 57/247; 57/287; 57/288; 57/903; 57/908

[58] Field of Search ..... 57/205–208, 57/236, 239, 289, 907, 908, 245–247

[56] References Cited

U.S. PATENT DOCUMENTS

| | | | |
|---|---|---|---|
| 2,911,784 | 11/1959 | Vandervoort | 57/903 X |
| 3,041,816 | 7/1962 | Stuewer | 57/236 |
| 3,153,895 | 10/1964 | Eckhardt | 57/903 X |
| 3,703,075 | 11/1972 | Bose | 57/903 X |
| 3,857,233 | 12/1974 | Cardinal et al. | 57/908 X |
| 4,060,970 | 12/1977 | Talbot | 57/289 X |
| 4,117,656 | 10/1978 | Ingham, Jr. | 57/289 X |
| 4,147,020 | 4/1979 | Oakes | 57/908 X |
| 4,169,349 | 10/1979 | Talbot | 57/289 |
| 4,242,862 | 1/1981 | Negishi et al. | 57/289 X |

FOREIGN PATENT DOCUMENTS

| | | |
|---|---|---|
| 52-121554 | 10/1977 | Japan . |
| 54-1825 | 1/1979 | Japan . |

*Primary Examiner*—John Petrakes
*Attorney, Agent, or Firm*—Austin R. Miller

[57] ABSTRACT

A method for manufacturing a sewing thread comprising the following steps:

drawing an undrawn polyester multifilament yarn;

preliminarily heat treating the drawn yarn at an effective heat treating temperature before false twisting;

then, false twisting the heat treated synthetic multifilament yarn at a temperature of at least 150° C.

subjecting the false twisted yarn to a fluid jet treatment under the slackened condition so as to intermittently interlace in a lengthwise direction constituent filaments of the yarn and so as to form protruded portions protruding from the surface of the yarn; and post-heat treating the interlaced yarn at an effective heat treating temperature being higher than the heat treating temperature of the false twisting.

By this method, a thread suitable for sewing can be obtained. The produced sewing thread comprises at least one polyester multifilament yarn, in which thread constituent filaments of the multifilament yarn are intermittently interlaced along the lengthwise direction thereof, and a part of the constituent filaments of the multifilament yarn is protruded from the surface of the multifilament yarn; and the torque of the sewing thread is very small in spite of the fact that substantially all filaments constituting the sewing thread have been subjected to the same false twisting.

26 Claims, 3 Drawing Figures

SEWING THREAD AND METHOD FOR MANUFACTURING THE SAME

This is a division of application Ser. No. 463,030, filed Feb. 1, 1984, now U.S. Pat. No. 4,513,565.

TECHNICAL FIELD OF THE INVENTION

The present invention relates to a novel sewing thread comprising one or more thermoplastic synthetic multifilament yarns, and it also relates to a method for manufacturing the same.

PRIOR ART

Conventionally known are various types of synthetic sewing threads, typically sewing thread made of spun yarn or false twist textured yarn. It is also known that a plurality of such spun yarns or false twist textured yarns are utilized as component yarns to form a sewing thread.

However, such conventional sewing threads have many disadvantages when they are actually used for sewing. For example, a sewing thread comprising one or more spun yarns as component yarns has a large variation in yarn strength. This variation results in frequent breakage of the sewing thread during sewing operations; and an inferior appearance in the sewn products because of inherent irregularity thread thickness a period inherent thereto. Contrary to this, a sewing thread comprising one or more ordinary false twist textured yarns, or ordinary drawn yarns, as component yarns has inferior sewability to that of a sewing thread comprising spun yarns. In addition, when a sewing thread comprising spun yarns is used in an industrial sewing machine at a high speed, thread breakage frequently occurs due to frictional heat. Based on this fact, it is generally believed that a thread having fluffs is preferable for a sewing thread.

Taking the background described above into consideration, it has been confirmed that an appropriate sewing thread must have good sewability and produce beautiful seams, and that a sewing thread having an excessively small torque, being cohered in one body and being provided with fluffs or fluff-like protruded fibers, achieves these results.

A sewing thread which complies with the above requirements cannot be realized by utilizing spun yarns or ordinary false twist textured yarns, because they have unsuitable torque or protruded structures. It has been found that the torque possessed by an ordinary flase twist textured yarn causes problems during sewing operations, and therefore, the torque is believed to be unsuitable for sewing thread. Furthermore, in some cases, the false twist crimps and the twist structure caused thereby are unnecessary for the sewing operation.

If a sewing thread has torque therein, a snarl is generated in the thread portion just before it enters the fabric to be sewn. If the sewing thread is slackened, snarls are generated and deteriorate the sewability of the thread. Especially when such a thread is used in a sewing machine, a number of disadvantages occur, such as: skipped stitches; an increase of thread breakage caused by a looper end; and an increase of thread breakage due to the entanglement between other parts of the sewing machine and the thread.

Accordingly, in conventional techniques, various attempts described in the following items (1) through (5) have been applied in order to reduce torque. However, these attempts at reducing torque have many industrial disadvantages when they are applied to sewing threads utilized in sewing machines for home use and industrial use.

(1) In order to balance torques, a yarn false twisted in an "S" direction and a yarn false twisted in a "Z" direction are doubled and interlaced to form a single yarn. Although this yarn is splended as a sewing thread, because torque therein can completely be diminished, disadvantages occur in that the process for manufacturing the yarn is highly complicated and the cost for manufacturing the yarn is rather expensive.

(2) A false twisted yarn is again subjected to a heat treatment in dry or wet heat in order to decrease torque, and a sewing thread is produced. A textured yarn produced in this manner is generally well known; however, there is a natural limitation for decreasing torque based on the conventional resetting treatment. Accordingly, a sewing thread having suitable properties cannot be produced within the usual conditions, even if the conditions are carefully selected. More specifically, it should be pointed out that the heat treatment after the false twisting operation in the conventional method is not carried out at such a high temperature or under such a stretching condition, because the heat treatment in the conventional method is intended to maintain: the thread strength; resistance to elongation under a low tension; and crimps in the thread. Therefore, the treatment is incompatible with the high temperature or stretching heat treatment.

(3) If additional twists are supplemented to a thread, it is possible to diminish torque, but only under certain special conditions, for example, under a condition of free tension. However, under other conditions, for example, the condition wherein the thread is subjected to a heat treatment another tension, or further release of such a tension, then torque may be developed, and therefore, the thread is not suitable for use as a sewing thread. The behavior of this yarn can be explained by the difference in properties of torques generated by false twists and real twists.

(4) A sewing thread having a two-folded thread structure may be desirable by balancing the initial twist and the final twist, if a component yarn does not have torque. Accordingly, if the single yarn described in item (1) above is used to form a two folded thread, a suitable sewing thread can be produced. However, this sewing thread has disadvantages which exceed those inherent to the single yarn in item (1); more specifically, the manufacturing process is more complicated and the manufacturing cost becomes more expensive. If a three or more folded thread structure, or a structure including initial, inter and final twists, is applied, the sewing thread has similar disadvantages.

(5) It is also possible to use a plurality of yarns having false twist torques in order to balance the three torques generated by false twist, initial twist and final twist. However, this thread has disadvantages similar to those described in item (3) above.

SUMMARY OF THE INVENTION

An object of the present invention is to provide a sewing thread which is composed of one or more polyester multifilament yarns and which is superior to a conventional sewing thread and a method for effectively manufacturing the sewing thread, through a false twisting process.

The present inventors have succeeded in obtaining a novel sewing thread which is superior to a conventional sewing thread and comprising one or more polyester false twisted multifilament yarns, the torque of which thread is at most 4 turns/50 cm, in spite of the fact that substantially all filaments constituting said yarns have torque in the same direction. This is accomplished by combining the texturing conditions applied to a false twisting step and the heat treating conditions applied to various heat treating steps.

According to the present understanding of the invention, a sewing thread with torque of at most 4 turns/50 cm is superior to any other conventional sewing threads when it is used for a sewing operation and does not result in significant increases in the manufacturing cost and the manufacturing steps. Contrary to this, a sewing thread with torque exceeding 4 turns/50 cm is in appropriate for a sewing thread.

Based on the present understanding that the most appropriate sewing thread is cohered and has protruded portions, the present invention utilizes the capability of false twisted filaments for developing crimps and torque as a mechanism for forming the protruded portions.

The sewing thread of the present invention has a construction characterized in that the torque of the sewing thread is at most 4 turns/50 cm, in spite of the fact that substantially all filaments constituting the sewing thread have been subjected to the same false twisting. The sewing thread of the present invention has a very low toruqe. The low torque of the present invention has not been obtained through a conventional method wherein textured yarns having opposite torques are doubled to form a yarn. The sewing thread of the present invention can basically be produced by using a single yarn manufactured in a single false twisting unit. According to the present invention, the yarn can be used in the form of a single yarn to form a sewing thread as explained above, and, in addition to this, a plurality of such textured yarns also can be used, in the form of a folded thread, as a sewing thread. Furthermore, this yarn can be used as a sewing thread for giving such stitching on the fabric a decorative appearance.

The sewing thread, and method for manufacturing the same according to the present invention, will now be explained in more detail.

DETAILED DESCRIPTION OF THE INVENTION

The expression "the torque of a sewing thread is at most 4 turns/50 cm" used herein is based on the following definition, from the point of view that certain trouble might be created in carrying out the sewing operation if the sewing thread is provided with a high torque under free relaxed conditions during a sewing process wherein the sewing thread is tensioned intermittently.

Figure 1:
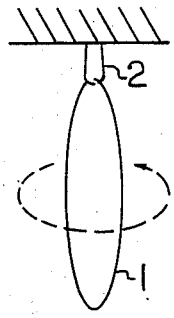
FIGS. 1 through 3 are model views illustrating steps for measuring torque as defined in the present invention.
Figure 2:
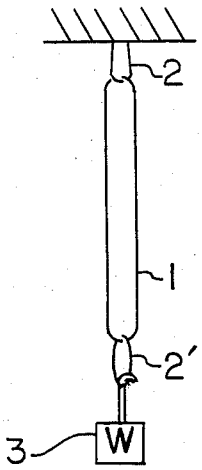
Figure 3:
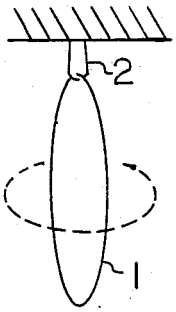

The expression means that the number of turns of a loop around a vertical axis until the loop becomes stationary is obtained by the following two steps (1) and (2) respectively.

a first step (1) wherein a sewing thread is formed in a single loop, said loop having a circumference of 1 m and being suspended from a thread made of the same material, as illustrated in FIG. 1, wherein 1 denotes a test piece sewing thread formed in a single loop, said loop having a circumference of 1 m, and 2 denotes a yarn suspending from the loop and made of the same material;

a second step (2) wherein a weight W of 1 gram/denier is applied to the lower end of the loop via a thread made of the same material, as illustrated in FIG. 2, wherein 3 denotes a weight W, which is hung from the loop by means of a yarn 2' made of the same material as the thread test piece, thereafter the weight is removed from the loop, as illustrated in FIG. 3.

In the above-mentioned measuring process, "the torque of a sewing thread is at most 4 turns/50 cm" which is defined in the present invention means that the number of turns of a loop around a vertical axis until the loop becomes stationary is at most 4 turns, in the respective conditions, that is, the relaxed condition as shown in FIG. 1 and the relaxed condition after taking-off the weight as shown in FIG. 3.

In a preferred embodiment of the present invention, the component yarn of the sewing thread is characterized by: portions protruding from the surface of the sewing thread; and an alternate structure consisting of an interlaced portion and a non-interlaced portion alternately arranged along the lengthwise direction of the yarn. Furthermore, the yarn is characterized in that it has substantially no twists therein, and in addition, it is characterized in that it is constituted of filaments having the same length.

It is preferable that the component yarn is made of a polyester. It is also preferable that the intrinsic viscosity (IV) of the yarn is in a range between 0.65 and 1.20, and that the average molecular weight is between about 21,000 and 41,000 (measuring conditions: at a temperature of 25° C. in O-chlorophenol solution having a concentration of 8% by weight). If the intrinsic viscosity (IV) of the yarn is included in that range, the strength of the produced thread is sufficiently high and is suitable for a sewing thread used in a sewing machine.

A preferably produced sewing thread of the present invention has an elongation of a remarkably small value, i.e., equal to or less than 5%, relative to the original length after the operations, wherein each operation, consisting of tensioning with 1 g/denier and releasing thereof, is repeated ten times. This supports the fact that the base portions of the protruded portions are fixedly secured within the thread, and the fact that the sewing thread has resistance to plastic or mechanical deformation. The sewing thread having a low elongation due to the tension and a high dimensional stability results in the increase in capability of a sewing thread to be sewn and the beautiful finish of the sewn product.

In another preferred embodiment of a polyester sewing thread according to the present invention, the sum of the elongation of the thread relative to the original length as measured by tensioning the thread with 1 g/denier and releasing the tension from the thread repeatedly ten times, and the shrinkage in dry heat (180° C. for 30 minutes) or in wet heat (130° C. for 30 minutes) is at most 5%, preferably at most 3%. The resultant sewing thread is stable to heat and tension and provides splended results when used in sewing.

According to another aspect of the present invention, a method for manufacturing the above-explained sewing thread is provided, which method comprises:

(1) preliminarily heat treating a polyester multifilament yarn;

(2) false twisting the heat treated polyester multifilament yarn;

(3) subjecting the false twisted yarn to a fluid jet treatment under the slackened condition so as to interlace partially with each other, along a lengthwise direction, constituent filaments of the yarn and so as to form protruded portions protruding from the surface of the yarn; and (4) post-heat treating the interlaced yarn.

The effective heat treatment temperatures which will be used in this specification are defined as follows:

(1) when a running yarn is heat treated by means of a contact type dry heater, the temperature of the contact type dry heater is the effective heat treating temperature;

(2) when a running yarn is heat treated by means of a straight hollow dry heater, the temperature lower than that of the straight hollow dry heater by 15° C. is the effective heat treating temperature;

(3) when a running yarn is heat treated by means of a steam heater, the temperature higher than that of the steam heater by 30° C. is the effective heat treating temperature; and (4) when a yarn package is heat treated by means of steam or in water, the temperature higher than that of the steam or water by 60° C. is the effective heat treating temperature.

The method of the present invention will now be explained in more detail. The method of the present invention comprises a preliminary heat treatment step, a false twisting step and a post-heat treatment step. Please note that the preliminary heat treatment is carried out at an effective temperature higher than that of the false twisting step. The method will specifically be described. The sewing thread of the present invention is manufactured by a false twisting step and a heat treatment in a slackened condition occurring subsequent to the false twisting step for forming protruded portions by relying on the capabilities of the component yarn for developing crimps and torque. The sewing thread is then subjected to a fluid interlacing treatment so as to interlace constituent filaments and so as to alternately form interlaced portions and non-interlaced portions along the lengthwise direction, and accordingly, a suitable coherency is achieved in the sewing thread. Furthermore, the sewing thread is subjected to special heat treatments, which are so adjusted that the effects created by the heat treatments are expected to have a particular relationship with the effects created by the false twisting heat set operation.

The characteristics of such a manufacturing process are that: the mechanism to form the protruded portions relies on the capabilities of the individual constituent filaments for developing crimps and torque, which capabilities are created by false twisting; the alternate interlacing treatment provides the sewing thread with coherency and the protruded portions with security within the thread; and an intensive post-heat treatment is effected at an effective heat treating temperature higher than that of the false twisting step and diminishes the effects generated by false twisting, and the process serves to manufacture as especially textured sewing thread. In such a manufacturing process, it is also effective, for production of a sewing thread of the present invention with decreased false twisted effects, to subject the thread to a preliminary heat treatment before the false twisting step, which treatment is effected at an effective heat treating temperature higher than that of the false twisting step. This is because, in some cases, the false twist crimps and the twist structure caused thereby are unnecessary for a sewing thread.

In conclusion, a polyester multifilament yarn of the present invention is subjected to at least two heat treatments in addition to that of the false twisting, i.e., the first one being performed before the false twisting operation and the second one being performed after the fluid jet treatment. It is very important that the effective heat treating temperatures in both cases are higher than that of the false twisting operation.

The above-explained process will now specifically be explained. A polyester multifilament yarn is subjected to a false twist texturing process comprising twisting, heat setting and detwisting, and then it is treated by means of a fluid jet interlacing device serving for intermittently interlacing the thread. The protruded portions are mainly formed by slackening the thread after it is false twisted. In a simple way, the thread is fed into a fluid jet interlacing device at a certain over-feed ratio after it is false twisted so as to be brought into a slackened condition at a portion upstream from the fluid jet interlacing device, and accordingly, filaments constituting the component yarn protrude by themselves because of the capabilities thereof for developing crimps and torque, and thereafter the base portions of the protruded portions are secured by the interlaced filaments caused by the intermittently interlacing treatment, and a component yarn, and accordingly, a thread, having protruded portions fixedly secured thereto, is produced. Since the protruded portions are formed not by broken ends of filaments, but by continuous portions of filaments, the withdrawal of such protruded portions does not occur easily. In addition, since the base portions of the protruded portions are fixedly secured, the displacement of such protruded portions is sufficiently prevented. The shape of the protruded portions may be formed in a bow-like shape, a loop or a snarl, or a combination of these shapes.

Since the filaments constituting the single polyester multifilament yarn are made of the same material and are subjected to the same treatment, as is apparent from the protruded portion forming mechanism, the filaments have substantially the same length on which the protruded portions are formed. Due to the substantially same length of the constituent filaments, the probabilities for forming the protruded portions are the same for all the filaments, and therefore, all the filaments are equally exposed to an external force due to the rubbing operation of the protruded portions. Because of the combination of this effect and the intermittent interlaced effect, the protruded portions are almost completely prevented from being displaced when they are subjected to an external force, such as a rubbing operation. Accordingly, the generation of neps is reduced. In addition, the strength efficiency of the component yarn can be remarkably enhanced because of the special construction of the thread. In comparison with this, if the thread is composed of two polyester multifilament yarns as component yarns and if only one of the component yarns is overfed to form protruded portions, the protruded portions may easily be moved and may be changed into neps. The strength efficiency of the component yarn is naturally low and is insufficient for a sewing thread, because yarn breakages occur frequently.

The capabilities of a component yarn, including the protruded portions, for developing crimps and torque are related to the false twisting conditions, especially the number of the false twists. If the number of false twists is small, the crimp configuration becomes large and results in large protruded portions, and at the same time, the capabilities for developing crimps and torque are weakened. If the number of false twists is further reduced, almost no protruded portions are formed. Contrary to this, if the number of false twists are large, although there are capabilities for developing crimps and torque, the crimp configuration becomes small and very small protruded portions are formed. As the number of false twists increases, the size of the protruded portions becomes small, and finally the protruded portions diminish. The range of the number of false twists, by which the usual false twist textured yarns are manufactured, substantially corresponds to the range of the number of false twists wherein no protruded portions are formed. Accordingly, in the method of the present invention, the number of false twists must be set relatively smaller than the number of false twists utilized for manufacturing the usual false twist textured yarns.

According to the present invention, the range of the number T (turns/m) of false twists wherein protruded portions re preferably formed is expressed as follows, $$2000\ T(D/\ )^{\frac{1}{2}}\ 7000$$

In this equation, D denotes the denier of polyester multifilament yarn which is to be false twisted, and denotes the specific gravity of the filament.

It is preferable that the slackened condition for creating protruded portions be in the range set forth below which is expressed as the slackened percentage in an embodiment wherein, after a component yarn is false twisted, it is overfed into a fluid jet interlacing device.

$$4\ (V_1/V_2)-1\times 100\ 20$$

In this equation, $V_1$ denotes the take-up speed upon false twisting, and $V_2$ denotes take-up speed upon interlacing. When an additional zone, wherein a component yarn is slackened after it is false twisted, is partitioned from a fluid interlacing zone via a take-up roller, it is preferable to also apply an over-feed ratio of between 4 and 20% which ratio is similarly derived from the above-mentioned equation. Similarly when a slackened zone is formed by means of other processes, it is basically preferable that the slackened percentage or overfeed ratio be selected in the range described above.

It is also possible to carry out a process for stretching a component yarn which has been false twisted by subjecting the yarn to a draft before, during or after the fluid treatment. Due to such stretching, the number and the size of the protruded portions can also be adjusted. For example, when a component yarn is once stretched after it is false twisted and before it is slackened, the number of the protruded portions can be more and the size thereof can be smaller relative to those produced when the yarn is not stretched. When a yarn is stretched during or after the fluid interlacing treatment, poorly held protruded portions may be diminished, and only the rigidly held protruded portions may selectively remain. Accordingly, sewing thread having a high resistance against a pulling force can be obtained, because the protruded portions are rigidly held.

The textured yarn produced through the above-explained process and having protruded portions rigidly secured thereto is superior to other yarns of the present invention, in neps and strength efficiency thereof. Other yarns produced through other processes, for example, two component yarns formed by two polyester multifilament yarns, one of which is overfed and is subjected to a false twisting operation or a fluid interlacing operation, have protruded portions that are formed in the filaments constituting the overfed yarn.

According to the present invention, a yarn having at least 200 protruded portions per one meter may be effectively used for a sewing thread, regardless of the mechanism used for forming the protruded portions. The number of protruded portions serve to reduce the coefficient of friction between the thread and sewing machine members, made of metal or other materials, such as a needle, or a guide. Accordingly, the capability of the thread to be sewn is remarkably enhanced. As a result, the sewing thread of the present invention, which is composed of filaments, is provided with the properties and the appearance of a sewing thread made of a spun yarn.

It is preferable that the number of interlaced portions be equal to or more than 40 per one meter, and that the length of a non-interlaced portion be equal to or less than about 15 mm.

Through the above-described processes, the yarn having protruded portions, base portions of which are rigidly secured within the yarn, is subsequently subjected to an intensive post-heat treatment, by which the torque and crimp properties applied through the false twisting step are decreased.

The intensive post-heat treatment is very important in producing the yarn of the present invention. The post-heat treatment must achieve heat treatment effects which are at least superior to those effected by the heat set effects achieved in the false twisting step, and, as a result, the molecular structures in the constituent filaments are returned to the condition before they were false twisted. When the post-heat treatment satisfies the requirement described above, a sewing thread of the present invention is produced and is characterized in that the torque of the component yarn is at most 4 turns/50 cm, in spite of the fact that substantially all filaments constituting the yarn have been subjected to the same false twisting and have torque in the same direction.

Accordingly, the heating condition of the post-heat treatment must be so selected that the heat treatment effects are superior to the heat set effects achieved by the false twisting, i.e., the temperature during the post-heat treatment must be substantially higher than the temperature during the false twist heat set treatment. However, it should be noted that the heat treatment effects of the post-heat treatment relate to the post-heat treatment system. In general, a continuous heat treatment, wherein a running yarn is treated, has inferior heat treatment effects to those achieved by a batch heat treatment, wherein a lot of packages are treated for a long time period, and therefore, the temperature difference of about 30° C. must be taken into consideration. Similarly, the temperature difference of about 30° C. must be taken into consideration between a dry heat treatment and a wet heat treatment, because the dry heat treatment achieves inferior heat treatment effects to those achieved by wet heat treatment. Furthermore, when the heat treatment is carried out by means of a hollow tubular heater, the temperature of the hollow tubular heater should be higher than that of a contact type heater.

Although there is no substantial difference between a heat treatment uner a slackened condition, wherein a yarn is heated treated while crimps in the yarn are being developed, and a heat treatment under a stretched condition, wherein a yarn is heat treated while crimps in the yarn are not being developed, when these heat treatments are used as a post-heat treatment, the stretched condition heat treatment is preferable in order to maintain the resistance of the yarn against the tensile force, because of the reasons described above. As explained above, the post-heat treatment can be carried out in dry heat or wet heat, and continuously or discontinuously (i.e., in batch system). When the conditions for the post-heat treatment are suitably selected, a sewing thread having a torque equal to or less than 4 turns/50 cm can be produced. When a wet heat treatment is applied to the post-heat treatment, the post-heat treatment may take place when the dyeing step is carried out. When a wet heat treatment is carried out, a textured yarn in a form of a single yarn may be subjected to such a wet heat treatment. Alternatively, if a sewing thread is used in a form of a folded thread, such as a two-folded thread or a three-folded thread, the sewing thread may be subjected to such a wet heat treatment, after such a folded thread is formed. When a folded thread is manufactured, it is unnecessary to take into consideration the special combination between an S-false twisted yarn and a Z-false twisted yarn, and accordingly, a plurality of substantially the same textured yarns can be utilized.

The present invention is applicable to a polyester fiber having specific intrinsic viscosity such as 0.65 1.20 is preferable because of the heat treatment effects clearly achieved therein, since the present invention utilizes particular heat treatments, as explained above. In addition, a sewing thread made of such a polyester as mentioned above has splended properties, superior to those of sewing thread made of other materials, in that, for example, elongation is relatively small.

When a sewing thread of the present invention is composed of one or more polyester multifilament yarns, according to the present inventors' experiences, it is preferable that, when the false twisting step is carried out by means of a contact type heater, and when the post-heat treatment is continuously carried out in dry heat by means of a hollow tubular heater, (1) the post-heat treatment is in a slackened condition, (2) the temperature of the post-heat treatment is equal to or higher than 210° C., (3) the temperature of the false twisting step is at least 150° C., and (4) the difference in the temperatures of the post-heat treatment and the false twisting step is equal to or more than 15° C. The temperatures should be suitably selected so that they satisfy the above-described requirements, and it has been confirmed that the torque in the constituent filaments is effectively reduced, if the difference in the temperature is large.

When a package is heat treated, it is necessary that an intensive wet heat treatment, for achieving the heat treatment effects higher than he heat set effects achieved during the false twisting step, be carried out. More specifically, it is necessary that the heat treatment temperature of the false twisting step be equal to or lower than the sum of the temperature of the wet heat treatment and 60° C. Generally speaking, torque in constituent filaments is effectively decreased, if the difference in the false twisting temperature and the sum is large.

From the point concerning heat treatment effects, that is, concerning a wet heat treatment, it is equally possible to carry out either: a slackened heat treatment wherein the heat treatment takes place while crimps are being developed; or a stretched heat treatment wherein heat treatment occurs while crimps are not being developed. Because of the reasons described above, in order to maintain the resistance of the yarn against tensile force, the wet post-heat treatment is preferably carried out in the stretched condition heat treatment. Incidentally, in order to reduce the steps, it is also possible to carry out the wet heat treatment together with a dyeing operation, such as a cheese dyeing operation. In this case, the slackened condition heat treatment is actually carried out.

When dry heat treatment is carried out, intensive and appropriate post-treatment conditions should be selected. More specifically, it is at least necessary to adjust such conditions so that an intensive post-heat treatment achieves heat treatment effects superior to those achieved by the false twisting heat set. If the false twisting is carried out by means of a contact heater, and if the post-heat treatment is carried out by means of hollow tubular heaters, the temperature of the post-heat treatment should be equal to or higher than the sum of the temperature of the false twisting heater and 15° C. A thread suitable for sewing can be produced when the difference between the temperature of the post-heat treatment and the sum is large. It is preferable that the temperature of the post-heat treatment be equal to or higher than 210° C. Furthermore, it is necessary that the post-heat treatment is carried out under a continuous under-feed condition, in other words, in a stretched condition.

Although there is no significant difference in heat treatment effects achieved by the post-heat treatment between the slackened heat treatment, wherein crimps are fully developed, and the stretched heat treatment, wherein crimps are not fully developed, the stretched heat treatment performed in an under-feed condition is preferable in order to obtain a sewing thread having resistance against tensile force, because of the reasons described above.

It is also effective for the present invention to carry out a preliminary heat treatment performed before the false twisting step together with a post-heat treatment carried out after the false twisting. It is preferable that the temperature of the preliminary heat treatment be at least 210° C. and be equal to or higher than the temperature of the false twisting step. In this case, it is also preferable that the temperature of the false twist heater be equal to or higher than 150° C. The preliminary heat treatment achieves advantages in increasing the strength of the component yarn and resistance to elongation, and in stabilizing the thermal properties of the component yarn, such as thermal shrinkage. Due to the preliminary heat treatment, the effects such as crimps and torque, achieved by false twisting which is carried out at a temperature lower than that of the preliminary heat treatment are made temporary. In other words, when a component yarn has been subjected to a preliminary heat treatment, the effects achieved by false twisting can easily be diminished later, and therefore, torque in a component yarn can be diminished when the yarn is subjected to a post-heat treatment, even under a slackened condition. In other words, even when a batch of packages are heat treated in a post-heat treatment, the yarn can maintain strength and resistance to elongation.

In the present invention, the preliminary heat treatment may be performed in a drawing zone in which an undrawn yarn or a partially drawn yarn is drawn under heated conditions or may be performed in a stretch heat treatment or a relaxed heat treatment applied just after the drawing process. If polyester fibers besides polyester fibers having an intrinsic viscosity (IV) of between 0.65 and 1.20 determined at a temperature of 25° C. in O-chloro phenol solution having a concentration of 8% by weight is utilized to produce a sewing thread, the above-explained characteristic effect could not be attained.

When the polyester multifilament yarn is subjected to the combined heat treatment, including the preliminary heat treatment, the false twisting and the wet post-heat treatment, it is preferable that the temperature of the false twisting be equal to or lower than the sum of the temperature of the wet post-heat treatment and 60° C., and that the temperature of the preliminary heat treatment be equal to or higher than the sum, and in addition, that the temperature of the preliminary heat treatment be equal to or higher than another sum of the temperature of false twisting and 20° C.

When the polyester multifilament yarn is subjected to the combined heat treatment, including the preliminary heat treatment, it is preferable that the temperature of the preliminary heat treatment be equal to or higher than the sum of the temperature of the false twisting and 20° C., and that the temperature of the dry post-heat treatment in a stretch condition be equal to or higher than a further sum of the temperature of the false twisting and 15° C.

As described above, it is important in the present invention that the temperature in each heat treatment that performed before the false twisting process and that performance after the fluid jet treatment, should be such an effective heat treating temperature as to provide more heat-setting effect to said filaments than the heat-setting effect obtained at the effective heat treating temperature provided in said false twisting process. However, these heat set conditions must be different from each other as mentioned above, and the suitable heat setting temperature should be varied in accordance to the heat setting medium adopted in this process. That is, in using a contact type dry heat system, as the yarn directly contacts said heater, the temperature of said heater is equal to the yarn temperature. So that, the temperature of said heater seems to be the effective yarn setting temperature. On the other hand, in the case of using a tubular heater with the yarn passing therethrough without contacting the inside wall of said heater, generally the yarn temperature will be 15° C. below the temperature of heater. Therefore, if a certain temperature is required as the most suitable heat setting temperature of the yarn, the temperature of said tubular heater must be set forth at 15° C. higher than that of the required yarn heat setting temperature. In the case of using a steam heater or heating system of yarns in a package form with steam or hot liquid, the effective yarn setting temperature will usually be 30° C. and 60° C. higher than that of each heating system, respectively.

Accordingly, in the present invention the basic concept of controlling the heating temperature of said heater is mainly dependent upon the heating system of using the contact type dry heating method, and in the case of using another heating system, the controlling method of the heat temperature is performed by using a temperature conversion formula, along with the basic concept given in the case of using the contact type dry heater.

The most suitable heat setting temperature required by a yarn which should be treated represents T °C., and, the conversion temperature required in the respective heat treatment system $T_n$ °C. is represented in the following formulas.

| System of heat set treatment | Conversion Temperature $T_n$ |
|---|---|
| The temperature of the heater in a contact type dry heating system: $T_1$ | $T = T_1$ |
| The same temperature in a non-contact type tubular heater system: $T_2$ | $T = T_2 - 15°$ C. |
| The same temperature in a steam heating system: $T_3$ | $T = T_3 + 30°$ C. |
| The same temperature in a yarn heat setting system in a package form in steam or hot liquid: $T_4$ | $T = T_4 + 60°$ C. |

A component yarn according to the present invention substantially has no twists therein and is suitable for a sewing thread, even if it is used as a single yarn. The yarn of the present invention has intermittently interlaced portions along the length of the yarn, so that the yarn has the appropriate coherency. The above-mentioned phrase "substantially has no twists" includes a twisted condition in a yarn which is twisted by a draw-twister, and, more specifically, includes a twist of at most 25 T/m. According to the inventors' experiences, the number of interlaced portions is preferably about 40 per meter and the length of a noninterlaced portion is preferably, at most, about 15 mm. As mentioned above, a component yarn of the present invention is very splendid for a sewing thread is comparison with known conventional yarns.

A sewing thread according to the present invention does not have irregularities in the thickness thereof, as compared with conventional yarns, and since a component yarn of the present invention is uniform in size, the sewing thread has the strength to be sewn and has the appropriate elongation, and therefore, when the thread of the present invention is utilized for sewing, the sewing operation can be carried out smoothly. Further, because the sewing thread of the present invention is uniform in thickness, the seam formed is uniform and has a good appearance and the shrinkage of the seam is very small, so that stretch puckers will not occur, and the effect of the stitches is beautiful.

According to a sewing thread of the present invention, the material of the thread is soft and the thread has many protruded portions, sio that the thread has a bulkiness and does not have resistance against friction and bending. Therefore, the sewing thread of the present invention can be easily made compatible with the cloth to be sewn.

Further, according to the sewing thread of the present invention, the dropping of fluffs seldom occurs, so that the cloth to be sewn and the throat plate of the sewing machine are not dirtied by fluffs. The thread of the present invention is resistant to the friction which is caused by contact of the thread with the eye of a sewing needle, so that changes in the properties of the sewing thread are very small. In the thread of the present invention, protruded portions of each of the component yarns are entangled with each other, so that tho coherency of the component yarns with each other is splended. Consequently, when the thread is cut, component yarns in the thread are not loosed at the cut end, and it is easy to thread the cut portion of the sewing thread into the eye of a sewing needle.

The present invention will now be explained with reference to some Examples of the present invention.

EXAMPLE 1

A drawn multifilament yarn of polyethylene terephthalate (200 denier; 72 filaments; intrinsic viscosity (IV), 0.70; average molecular weight Mn, 2300; strength, 7.1 g/denier; and breaking elongation, 18%) was subjected to a preliminary heat treatment at a temperature of 190° C. in a stretched condition and was false twisted at a temperature of 175° C. with twists of 1400 T/m. Thereafter, while the yarn was slackened by 13.5%, it was interlaced by means of a fluid jet intermittent interlacing device. Then, it was heat set at a temperature of 220° C. using an under-feed condition, the under-feed ratio of which was 6%.

The thus produced yarn had a torque of at most 2.4 turn/50 cm determined by the above-explained two measuring steps, and also had many protruded portions. When this yarn was utilized for sewing, the sewability was splendid. The yarn had an elongation, measured as mentioned previously, of 1.4% and a shrinkage of 4.5% at dry heat of 180° C.

EXAMPLE 2

Subsequent to the drawing process by which the supply yarn utilized in Example 1 was produced, the yarn was dry heat treated at a temperature of 230° C. using an over-feed condition, the over-feed ratio of which was 0.6%. The thus produced polyethylene terephthalate multifilament yarn (200 denier; 72 filaments) was false twisted at a temperature of 170° C. with twists 1500 T/m. Thereafter, while the yarn was slackened by 13.6%, it was interlaced by means of a fluid jet intermittent interlacing device, and it was wound into a package. The thus produced package was heat treated in boiled water having a temperature of 130° C. for 40 minutes in a cheese dyeing machine.

Thus, the produced yarn had a torque of at most 1.0 turn/50 cm. When this yarn was utilized for sewing, the sewability was splendid. The elongation of this thread, measured as mentioned previously, was 2.0%, and its shrinkage at a dry heat of 180° C. was 3.0%.

COMPARISON 1

A yarn was produced by the substantially same manner as indicated in Example 1, except for a temperature of 210° C. upon false twisting and no preliminary heat treatment. The thus produced yarn had a torque of 24 turns/50 cm measured by the above-explained first measuring step (the direction of false twisting being an "S" direction; the direction of said torque being an "S" direction). Said yarn was not suitable for sewing because the yarn had such a large torque.

COMPARISON 2

A yarn produced by the above-mentioned Comparison 1 was twisted by 70 T/m in an S direction, and its torque was measured according to two measuring steps mentioned above. The following results were obtained.

First measuring step (without a weight): 0 turn/50 cm

Second measuring step (loading weight and thereafter removing this weight): 18 turns/50 cm ("S" twist)

Consequently, it was confirmed from the above-mentioned results that, when tension was applied to the yarn, torque was developed in the yarn. In an actual sewing operation, tension is applied to a sewing thread. Therefore, the above-mentioned yarn is not suitable for sewing.

EXAMPLE 3

A drawn multifilament yarn of polyethylene terephthalate (100 denier; 36 filament; intrinsic viscosity (IV), 0.71; average molecular weight Mn, 23,800; strength, 7.2 g/denier; and breaking elongation, 19%) was subjected to a preliminary heat treatment at a temperature of 200° C. under a stretched condition, and then was false twisted at a temperature of 180° C. with twists of 1500 t/m. Thereafter, while the yarn was slackened by 13.6%, it was interlaced by means of a fluid jet intermittent interlacing device. Then, it was dry heat set at a temperature of 220° C. using an under-feed condition, the under-feed ratio of which was 6%.

A three-folded thread was made of the thus obtained component yarns, with the initial twist being an "S" twist of 750 T/m and the final twist being a "Z" twist of 500 T/m. Then the folded thread was dyed at a temperature of 130° C. in a cheese dyeing machine.

The thus produced thread had a torque of at most 2.2 turns/50 cm determined by the above-explained two measuring steps, and also had many protruded portions. When this thread was utilized for sewing, the sewability was excellent. The elongation, measured as mentioned above, of this sewing thread was 1.9%, and its shrinkage at a dry heat of 180° C. was 2.9%.

EXAMPLE 4

Subsequent to the drawing process by which the supply yarn, utilized in Example 3, was produced, the yarn was dry heat treated at a temperature of 230° C. under an over-feed condition, the over-feed ratio of which was 0.6%. The thus produced polyethylene terephthalate multifilament yarn (100 denier; 36 filaments) was false twisted at a temperature of 170° C. with an "S" twist of 1500 T/m. Thereafter, while the yarn was slackened by 13.6%, it was interlaced by means of a fluid jet intermittent interlacing device, and it was wound into a package.

A three folded-thread was made of the thus obtained component yarns, where the initial twist was an "S" twist of 750 T/m and the final twist was a "Z" twist of 500 T/m. Then, the folded thread was dyed at a temperature of 130° C. in a cheese dyeing machine.

The thus produced thread had a torque of 1.8 turns/50 cm in an "S" direction measured by the above-explained first measuring step, a torque of 3.2 turns/50 cm in an "S" direction measured by the second measuring step.

COMPARISON 3

Three kinds of three-folded threads were respectively made of the following three kinds of yarns A, B, and C, where the initial twist was an "S" twist of 750 T/m and the final twist was a "Z" twist of 500 T/m. Each of the three-folded threads was dyed at a temperature of 130° C. in a cheese dyeing machine.

Yarn A: A drawn multifilament yarn of polyethylene terephthalate having an intrinsic viscosity of 0.62 (100 denier; 36 filaments)

Yarn B: A false twisted yarn composed of the above-mentioned yarn A, which was false twisted at a temperature of 215° C. with an "S" twist of 3000 T/m.

Yarn C: A yarn produced by heat setting the above-mentioned yarn B at a temperature of 205° C. under an over-feed condition, the over-feed ratio of which was 18%.

The three-folded thread composed of yarns A had a torque of 0 turn/50 cm, another three-folded thread composed of yarns B had a very large torque and the other three-folded thread composed of yarns C also had a very large torque.

Consequently, it was confirmed the result of the examination of yarn A, i.e., the torque of yarn A being zero, that the initial twist of 750 T/m in an S direction was well balanced with the final twist of 500 T/m in a Z direction. Further, it was confirmed from the results of the examinations of yarns B and C, i.e., their torque being very large, that a folded thread composed of conventional false twisted yarns generally has a large torque. However, as mentioned above, the thread of the present invention obtained by Example 4 has a very small torque, in spite of the yarn having been subjected to a false twisting operation.

Furthermore, various three-folded threads composed of said yarns B or C were produced by changing the combination of the numbers of initial and final twists, in order to balance torque of the false-twist, initial twist and final twist. However, threads, having very small torques, determined by the above-mentioned two measuring steps, could not be produced.

The three-folded thread of yarn A was composed of conventionally drawn yarns, and such a folded thread is not suitable for sewing, as explained in conjunction with the prior art in this specification. The three folded threads of yarn B and of yarn C were not suitable for sewing, irrespective of the numbers of initial and final twists.

EXAMPLE 5

A sewing thread was produced by substantially the same manner as indicated in Example 4, except for the "Z" twist applied in the false twisting operation. Torques of this thread, examined by the above-explained two measuring steps, were respectivelly an "S" twist of 0.2 turns/50 cm in the first step, a "Z" twist of 3.5 turns/50 cm in the second step.

COMPARISON 4

A three-folded thread was made of the three drawn polyester multifilament yarns having an intrinsic viscosity of 0.71 (100 denier; 36 filaments) as used in Example 3, where the initial twist was an "S" twist of 750 T/m and the final twist was a "Z" twist of 500 T/m. Then the folded thread was dyed at a temperature of 130° C. in a cheese dyeing machine. The thus produced yarn had a torque of 0 turn/50 cm.

This thread was similar to the thread in Example 3 in twist structure, but it was only composed of drawn yarns neither suffered from any heat treatment nor false twisting operation. Therefore, the thread was not suitable for sewing, as mentioned in connection with the prior art in this specification.

COMPARISON 5

A sewing thread was produced by substantially the same manner as explained in Example 3, except for a temperature of 210° C. in the false twisting operation with an "S" twist. The thus produced thread had torques in an "S" direction of 17 turns/50 cm, and 20 turns/50 cm, respectively, measured by the two measuring steps. This yarn was not suitable for sewing due to the large torque thereof.

COMPARISON 6

A sewing thread was produced by substantially the same manner as explained in Comparison 5, except for the twisting condition. Namely, an initial twist of 800 T/m in an "S" direction, and a final twist of 450 T/m in a "Z" direction were used. The torques of this thread were examined based on the two measuring steps and the following results were obtained.

First step: 0 turn/50 cm

Second step: 6 turns/50 cm in an "S" direction

As a result, it was confirmed that, when tension was applied to the thread, torque, which had been given to the yarn by false twisting, was developed in the thread. Because in an actual sewing thread operation tension is applied to a sewing thread, the above-mentioned thread is not suitable for sewing.

EXAMPLE 6

A multifilament yarn of polyethylene terephthalate having an intrinsic viscosity of 0.65 (70 denier; 24 filaments strength, 4.5 g/denier and breaking elongation 18%) was subjected to a preliminary heat treatment at a temperature of 210° C. under 3% slackened condition and was false twisted at a temperature of 190° C. with twists of 1500 T/m. Thereafter, while the yarn was slackened by 14%, it was interlaced by means of a fluid jet intermittent interlacing device. Then, it was heat set at a temperature of 220° C.

A three-folded thread was made of the thus obtained component yarns, where the initial twist was an "S" twist of 900 T/m and the final twist was a "Z" twist of 600 T/m. Then, the folded thread was dyed at a temperature of 130° C. in a cheese dyeing machine. The produced yarn had the following characteristics.

Shrinkage factor in dry heat (180° C. for 30 minutes) was was 1.5%.

Number of toruqes was 5.0 turns/50 cm.

The elongation mentioned above, i.e., the elongation of the yarn relative to the original length after operations performed ten times, each operation consisting of tensioning with 1 g/denier and releasing thereof, was 1.0%.

The strength was 4.2 g/denier.

The number of protruded filaments was 250 per meter. The produced thread was splendid as a sewing thread.

EXAMPLE 7

A drawn multifilament yarn of polyethylene terephthalate (70 denier; 24 filaments having an intrinsic viscosity of 1.15 strength, 7.4 g/denier and breaking elongation 19%) having been subjected to a preliminary heat treatment at a temperature of 190° C. in a stretched condition was false twisted at a temperature of 170° C. with twists of 1600 T/m. Thereafter, while the yarn was slackened by 13.6%, it was interlaced by means of a fluid jet intermittent interlacing device. Then it was wound into a package.

Then, a three-folded thread was made of the above-mentioned component yarns, where the initial twist was an "S" twist of 900 T/m and the final twist was a "Z" twist of 600 T/m. The folded thread was heat treated as a package in water having a temperature of 130° C., for 40 minutes in a cheese dyeing machine.

The produced thread had a number of protruded portions of filaments and had a small torque. When this thread was utilized for sewing, the sewability was splendid. This thread had an elongation, measured as mentioned above, of 2.5% and a shrinkage in dry heat at 180° C. of 4.5%.

In addition to the above-mentioned experiment in Example 7, various experiments were carried out in the same manner as the above-mentioned experiment, while various temperatures were adopted during the false twisting operation, in order to confirm the effects of the present invention. It was confirmed that, as the temperature was increased, the torque of the yarn was increased and that, when the temperature was over 190° C., the torque of the yarn become too large to use the yarn as a sewing thread. When the temperature was decreased, the torque of the yarn was also decreased. However, in a case where the temperature was lowered below 150° C., the number of protruded portions of filaments in the yarn was decreased, the protruded portions were irregularly distributed along the yarn, and some of the protruded portions were very long and large. Therefore, such a yarn was not suitable for sewing.

EXAMPLE 8

Subsequent to the drawing process by which an undrawn multifilament yarn of polyethylene terephthalate (intrinsic viscosity (IV), 0.75; average molecular weight Mn, 25400) was drawn, the yarn was preliminary heat treated by running the yarn in contact with a heat plate having a temperature of 230° C. using an over-feed condition, the over-feed ratio of which was 0.6%. As a result, a multifilament yarn (100 denier; 36 filaments) was produced.

Then the multifilament yarn was false twisted at a temperature of 200° C. with an "S" twist of 1500 T/m. Thereafter, while the yarn was slackened by 13.6%, it was interlaced by means of a fluid jet intermittent interlacing device. Then, it was post-heat treated at a temperature of 230° C. in dry heat using an under-feed condition, the under-feed ratio of which was 6%.

Then, a two-folded thread was made of said produced component yarns, while the initial twist was an "S" twist of 750 T/m and the final twist was a "Z" twist of 500 T/m. The folded thread was wet-heat treated at a temperature of 130° C. in a cheese dyeing machine.

The thus produced thread had torques of an "S" twist of 1.0 turn/50 cm, and an "S" twist of 2.8 turns/50 cm, said torques being respectively measured by the two measuring steps, and the thread had a number of protruded portions.

When this thread was utilized as a sewing thread, it was confirmed that the ability to be sewn thereof was splendid. The elongation mentioned above of this thread was 0.6%, and the shrinkage in dry heat at 180° C. thereof was 1.4%.

COMPARISON 7

Three kinds of three-folded threads were respectively made of the following three kinds of yarns A, B and C, where the initial twist was an "S" twist of 750 T/m and the final twist was a "Z" twist of 500 T/m. Then, each of the three-folded threads was wet-heat treated at a temperature of 130° C. in a cheese dyeing machine.

Yarn A: A drawn multifilament yarn of polyethylene terephthalate (100 denier; 36 filaments having an intrinsic viscosity of 0.63 strength, 4.2 g/denier and breaking elongation 18%), which yarn was the same yarn as obtained before a preliminary heat treatment, i.e., just after the drawing process in Example 8.

Yarn B: A false twisted yarn composed of the above-mentioned yarn A, which was false twisted at a temperature of 215° C. with an "S" twist of 3000 T/m.

Yarn C: A yarn produced by heat setting the above-mentioned yarn B at a temperature of 205° C. using an over-feed condition, the over-feed ratio of which was 18%.

The three-folded thread composed of yarns A had a torque of 0 turn/50 cm, another three-folded thread composed of yarns B and the still another three-folded thread composed of yarns C respectively had very large torques.

Consequently, it was confirmed from the result of the examination of yarn A, i.e., the torque of yarn A being zero, that the initial twist of 750 T/m in an "S" direction was well balanced with the final twist of 500 T/m in a "Z" direction. Further, it was confirmed from the results of the examination of yarns B and C; i.e., their torques being very large, that a folded thread composed of conventional false twisted yarns generally has a large torque. However, as mentioned-above, the thread of the present invention obtained by Example 4 has a very small torque, in spite of the yarn having been subjected to a false twisting operation.

Furthermore, various three-folded threads composed of said yarns B or C were produced by changing the combination of the number of initial and final twists in order to balance torques of a false-twist, an initial twist and a final twist. However, a yarn, having very small torques determined by the above-mentioned two measuring steps, could not be produced.

COMPARISON 8

Undrawn multifilament yarns of polyethylene terephthalate were produced from the respective polyethylene terephthalate chips having various intrinsic viscosities by means of melt-spinning, and these yarns were subjected to the following identical drawing and heat treatment so that polyester multifilament yarns (70 denier; 24 filaments having various intrinsic viscosities) were produced. In the above-mentioned drawing and heat treatment, each undrawn yarn was preliminary heat treated by running the yarn in contact with a drawing pin having a temperature of 100° C. and also a heat plate having a temperature of 190° C., thereafter the yarn was heat treated by running the yarn in contact with a heat plate having a temperature of 230° C. The above-mentioned two stages of treatment was carried out continuously under an over feed condition (the over feed ratio was 0.6%).

Then each drawn yarn was false twisted at a temperature of 200° C. with "S" twist of 500 T/m. This false twisted yarn was continuously subjected to an interlacing treatment under an over feed condition of over feed ratio 13.6% and further continuously subjected to a heat treatment by running the yarn through a heating chamber of 230° C. in a stretching condition of 6%. Next, three-folded threads were made of the various interlaced yarns produced by the above-mentioned treatments, while the initial twist of each three-folded yarn was an "S" twist of 900 T/m and the final twist thereof was a "Z" twist of 600 T/m. These fold twisted yarns were dyed under a temperature of 130° C. by applying the conventional cheese dyeing method. Then the tensile strengths of these three folded twisted yarns were measured and the following data were obtained, that is a sample yarn A (Intrinsic Viscosity (IV) of the material PET chip is 0.62) has a tensile strength (g/d) of 4.30, a sample yarn B (IV of 0.65) has a tensile strength (g/d) of 4.50, a sample yarn C (IV) of 0.72) has a tensile strength (g/d) of 5.17. According to the above-mentioned experimental test it was confirmed that, if the intrinsic viscosity of the polyethylene terephthalate chip is over 0.65, the tensile strength of the above-mentioned three folded yarn could exceed over 4.5 g/d which has been understood as lower limit of the tensile strength of the sewing thread utilized for the conventional sewing machine.

We claim:

1. A method for manufacturing a sewing thread comprising the following steps:

(1) preheating a polyester multifilament yarn having an intrinsic viscosity (IV) of between 0.65 and 1.20 determined at a temperature of 25° C. in O-chloro phenol solution having a concentration of 8% by weight;

(2) false twisting said preheated polyester multifilament yarn;

(3) subjecting said false twisted yarn to a fluid jet treatment under a slackened condition so as to interlace along a lengthwise direction constituent filaments of said yarn and so as to form yarn portions protruding from the surface of said yarn; and (4) post-heat treating said interlaced yarn.

2. A method according to claim 1, wherein said preheating step is carried out at an effective temperature higher than that of said false twisting operation.

3. A method according to claim 1, wherein said post-heat treatment is carried out at an effective temperature higher than that of said false twisting operation.

4. A method according to claim 1, wherein said preliminary heat treatment is performed in a dry heating system.

5. A method according to claim 1, wherein said preliminary heat treatment is performed in a wet heating system.

6. A method according to claim 1, wherein said post-heat treatment is performed in a dry heating system.

7. A method according to claim 1, wherein said post-heat treatment is performed in a wet heating system.

8. A method according to claim 6 or 7, wherein said post-heat treatment is performed under a stretching condition.

9. A method according to claim 6 or 7, wherein said post-heat treatment is performed under a slackened condition.

10. A method according to claim 1, wherein the heat setting temperature of said false twisting operation is at least 150° C.

11. A method according to claim 1, 2, 4 or 5, wherein said preliminary heat treatment is carried out at an effective heat treating temperature which is higher than that of the heat treatment in said false twisting step, wherein the effective heat treating temperatures are defined as follows, (1) when a running yarn is heat treated by means of a contact type dry heater, the temperature of said contact type dry heater is the effective heat treating temperature;

(2) when a running yarn is heat treated by means of a straight hollow dry heater, the temperature lower than that of said straight hollow dry heater by 15° C. is the effective heat treating temperature;

(3) when a running yarn is heat treated by means of a steam heater, the temperature higher than that of said steam heater by 30° C. is the effective heat treating temperature;

(4) when a yarn package is heat treated by means of steam or in water, the temperature higher than that of the steam or water by 60° C. is the effective heat treating temperature.

12. A method according to claim 11, wherein said effective heat treating temperature of said preliminary heat treatment is at least 210° C.

13. A method according to claim 1, 3, 6 or 7, wherein said post-heat treatment is carried out at an effective heat treating temperature which is higher than that of the heat treatment in said false twisting step and wherein the effective heat treating temperatures are defined as follows.

(1) when a running yarn is heat treated by means of a contact type dry heater, the temperature of said contact type dry heater is the effective heat treating temperature;

(2) when a running yarn is heat treated by means of a straight hollow dry heater, the temperature lower than that of said straight hollow dry heater by 15° C. is the effective heat treating temperature;

(3) when a running yarn is heat treated by means of a steam heater, the temperature higher than that of said steam heater by 30° C. is the effective heat treating temperature;

(4) when a yarn package is heat treated by means of steam or in water, the temperature higher than that of the steam or water by 60° C. is the effective heat treating temperature.

14. A method according to claim 13, wherein said effective heat treating temperature of said post-heat treatment is at least 210° C.

15. A method according to claim 1, wherein the twist number of said false twisting operation is expressed in following formula $$2000\ T(D/\ )^{\frac{1}{2}}\ 7000$$

wherein,

T represents the number of false twists (turns/m);

D represents the denier of the yarn; and represents the specific gravity of the filament.

16. A method according to claim 1, wherein the polyester filaments have an average molecular weight Mn of between 21,000 and 41,000.

17. A method according to claim 1, wherein an overfeed condition in the fluid treatment after the false twisting operation is satisfies the following formula:

$$4\ (V_1/V_2)-1\times 100\ 20$$

wherein $V_1$ represents a take up speed in the false twisting operation, and $V_2$ represents a take-up speed in the interlacing process.

18. A method according to claim 1, wherein a fluid treatment is performed by using a fluid jet nozzle in which an ejected fluid flow is impinged on the yarn, transversely to the axis of said yarn, so that interlaced portions and non-interlaced portions are provided on the yarn intermittently along said yarn axis.

19. A method according to claim 18, wherein said ejected fluid flow is impinged on the yarn at a right angle to the axis of said yarn.

20. A method according to claim 1, wherein a twisting operation for twisting a plurality of synthetic multifilament yarns is performed after the post-heat treatment.

21. A method according to claim 1, wherein a twisting operation for twisting a plurality of multifilament yarns is performed before the post-heat treatment.

22. A method according to claim 1, wherein said preliminary heat treatment is performed coincidently with a heat treatment of the drawing of said multifilament yarn.

23. A method according to claim 1, wherein said preliminary heat treatment is performed following a drawing operation of said multifilament yarn.

24. A method according to claim 1, wherein said preliminary heat treatment is performed at an effective heat treatment temperature being higher by 20° C. than that of the false twisting operation and being higher than 210° C. and wherein the effective heat treating temperatures are defined as follows, (1) when a running yarn is heat treated by means of a contact type dry heater, the temperature of said contact type dry heater is the effective heat treating temperature;

(2) when a running yarn is heat treated by means of a straight hollow dry heater, the temperature lower than that of said straight hollow dry heater by 15° C. is the effective heat treating temperature;

(3) when running yarn is heat treated by means of a steam heater, the temperature higher than that of said steam heater by 30° C. is the effective heat treating temperature;

(4) when a yarn package is heat treated by means of steam or in water, the temperature higher than that of the steam or water by 60° C. is the effective heat treating temperature.

25. A method according to claim 24, wherein said post-heat treatment after said fluid jet treatment is performed under a stretching condition and at an effective heat treating temperature higher than that of the false twisting operation and below the effective heat treating temperature of said preliminary heat treatment.

26. A method according to claim 25, wherein a plurality of said multifilament yarns are twisted with each other resulting in a folded thread.

* * * * *

UNITED STATES PATENT AND TRADEMARK OFFICE

CERTIFICATE OF CORRECTION

PATENT NO. : 4,656,825

DATED : 4/14/87

INVENTOR(S) : Takao Negishi; Teiryo Kojima

It is certified that error appears in the above-identified patent and that said Letters Patent is hereby corrected as shown below:

Column 13, Paragraph titled EXAMPLE 1, line 3 reads "(IV), 0.70; average molecular weight Mn, 2300;" should read "(IV), 0.70; average molecular weight Mn, 23200".

Signed and Sealed this

Eighth Day of August, 1989

*Attest:*

*Attesting Officer*

DONALD J. QUIGG

*Commissioner of Patents and Trademarks*